United States Patent [19]

Van Riper

[11] 4,246,699

[45] Jan. 27, 1981

[54] NUT CUTTING OR NUT BREAKING TOOL

[76] Inventor: Cliff Van Riper, P.O. Box 6897, San Jose, Calif. 95150

[21] Appl. No.: 925,275

[22] Filed: Jul. 17, 1978

[51] Int. Cl.[3] ..... B26B 17/02

[52] U.S. Cl. ..... 30/182

[58] Field of Search ..... 30/124, 180, 182, 241, 30/183, 189, 228

[56] References Cited

U.S. PATENT DOCUMENTS

| | | | |
|---|---|---|---|
| 806,493 | 12/1905 | Plummer | 30/182 X |
| 2,688,797 | 9/1954 | Swanson | 30/241 X |
| 2,994,955 | 8/1961 | Dowley | 30/182 X |
| 4,057,897 | 11/1977 | Seymour | 30/182 |

*Primary Examiner*—Jimmy C. Peters
*Attorney, Agent, or Firm*—Jack M. Wiseman

[57] ABSTRACT

A nut cutting tool in which a cutting head includes a yoke for embracing a nut to be cut and for supporting a fixed blade as close as possible to the nut, the cutting head guidably supporting a moveable cutter in a cutting plane toward the fixed blade and nut by a thrust from a pressure exerting means at right angles to the cutting plane including a second guidable element in the form of a wedge block operatively associated with the pressure exerting means and having an inclined cam surface facing the non cutting end of the movable cutter for forcibly urging the latter toward the nut to be cut.

7 Claims, 7 Drawing Figures

7
4
2
10
11
12
13
14
15
16
17
18
19
20
21
22
23
24
25
26
27
28
29
30
31
32
33
N

NUT CUTTING OR NUT BREAKING TOOL

This invention relates to nut cutting or nut breaking tool.

BACKGROUND

Nut cutting tools are common and well known. They are used for the purpose of removing a poorly installed nut which has become rusted, and so corroded as to make normal removal thereof by unthreading impossible. By cutting and or breaking such corroded nut from a threaded throat on drains and water supply pipes, the original pipes are preserved against damage and/or loosening relative to a fixture.

Basically all nut cutting tools entail means for embracing the nut to be removed including a fixed cutting blade, a movable cutting blade guided for movement toward the fixed blade and means for forcibly moving it toward the nut therebetween for cutting the nut free of the pipe upon which it had been threadedly connected. In most cases the means for forcibly moving the movable cutting blade is a screw shank mounted on the nut embracing means in axial alignment with the movement of the movable cutter guided therein. A right angled lever or wrench on the free end of a screw shank is a common and well known means for tightening the screw shank toward the movable cutting blade and nut to be cut. Such arrangement poses a problem when applied to a nut on a drain pipe or water line up under a sink, face bowl and the like where no lateral space is available for the extended screw shank. The space thereunder being limited requires some means at right angle to the drive line of movement of the movable cutter blade.

U.S. Pat. No. 496,396 granted May 2, 1893 to E. Chaquette shows one form of moving means wherein linkages are employed between the drive line of movement of the cutter blade and a handle angularly disposed relative to such drive line.

In a more recent U.S. Pat. No. 3,660,897 granted May 9, 1972 to A. L. Gilmore the drive means is a dog leg pivotally mounted in a slotted brace between the guideway for the movable cutter and a screw supporting shank disposed perpendicular to the line of drive of the movable cutter. In this arrangement the pivoted dog leg has an arm disposed in a slot provided therefor in the movable cutter body so as to reciprocate the latter along the guideway and for reversably retracting the movable cutter therealong. An opposite arm of the pivoted dog leg has pivotal connection with the upper end of a connecting rod, the lower end of which rod is swivably connected to the upper end of a screw threaded in the perpendicularly disposed screw supporting shank and having a ball and socket connection with the rod so that the dog leg can be withdrawn via the mechanical linkage with the movable cutter blade to achieve retractibility thereof from as well as movement toward a nut to be cut.

The foregoing arrangement is vulnerable to breakdown under the extreme pressure of force required to cut and break a nut. For example,, shearing of the pivots can occur at the mounting of the pivoted dog leg lever as well as between the dog leg arm and connecting rod at the upper end of the screw shank drive means.

The present invention seeks to alleviate such break downs by providing a more direct force transmitting medium between the angularly disposed drive means and the movable cutting knife.

Accordingly it is an object of the present invention to provide an improved nut cutting tool in which a more direct pressure can be directed to the movable cutting knife from an angularly disposed pressure exerting means. It is another object to provide a cutting head for supporting the movable cutting knife for movement in a cutting plane at right angles to a pressure exerting means.

It is yet another object to provide the cutting head with a fixed blade on a yoke for supporting the fixed blade in the cutting plane as close as possible to a nut to be cut to minimize the stroke of cut regardless of the size of the nut to be cut.

It is still another object to provide a handle like sleeve for the angularly disposed pressure exerting means and to provide such sleeve with a guideway normal to the cutting plane for guiding a cam wedge for movement within the handle like sleeve for wedgingly driving the movable cutting knife toward the nut to be cut.

These and other objects and advantages of the present invention will become apparent from a reading of the following detailed description in the light of the accompanying two sheets of drawing in which.

Figures 1, 3, 4, 6:
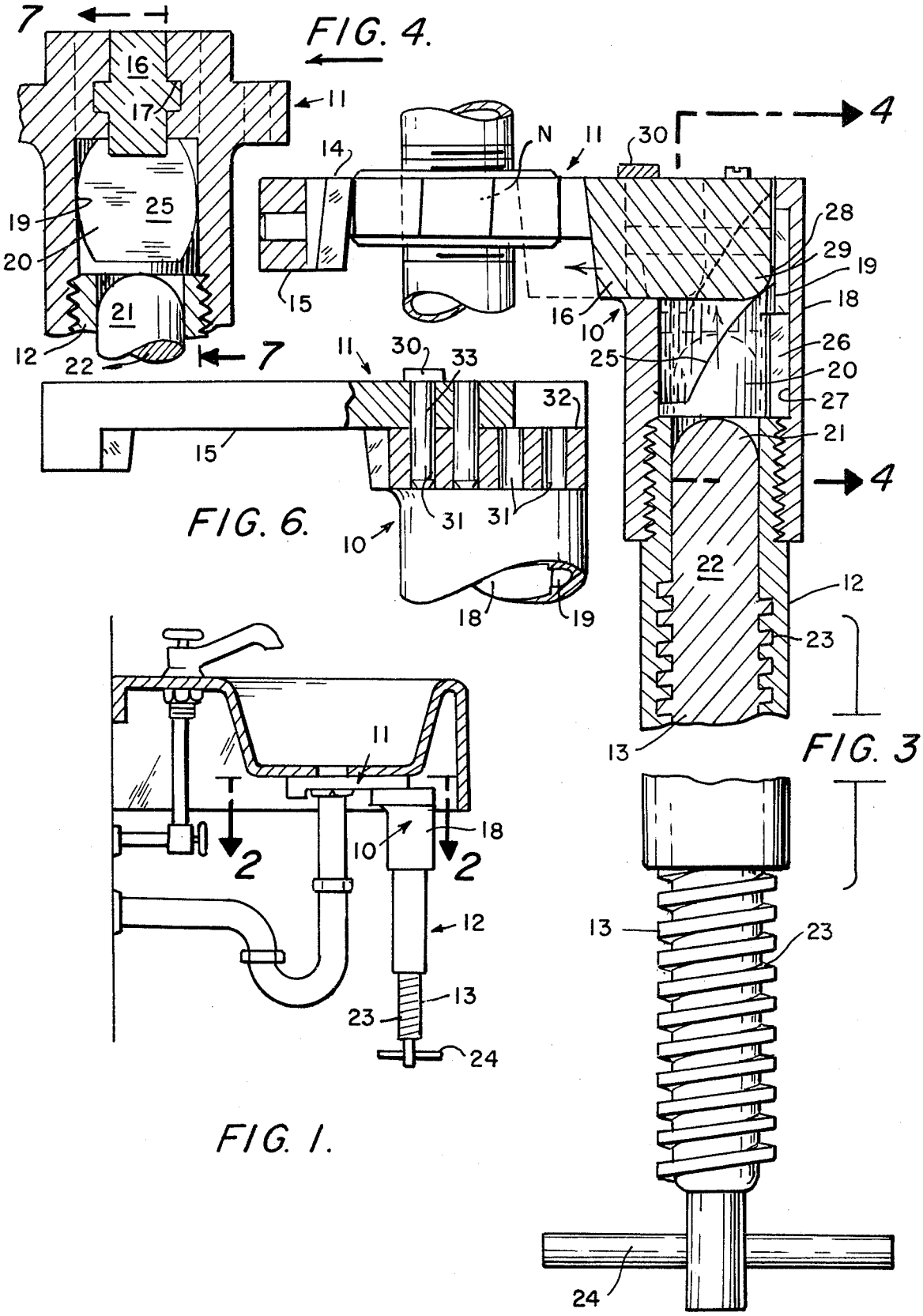
FIG. 1 is a vertical section through a face bowl type sink to illustrate the application of the nut cutting tool of the present invention thereto.
Figure 5:
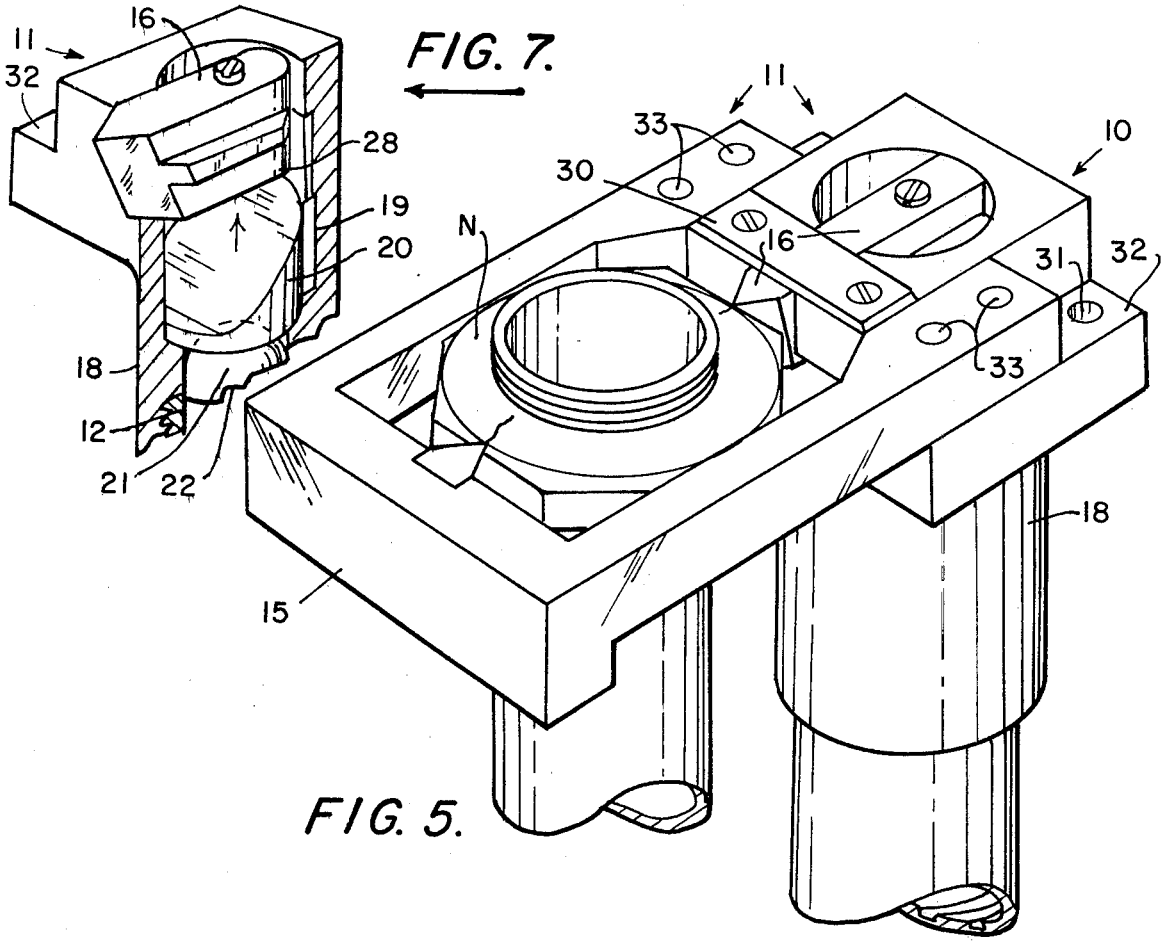
Figure 2:
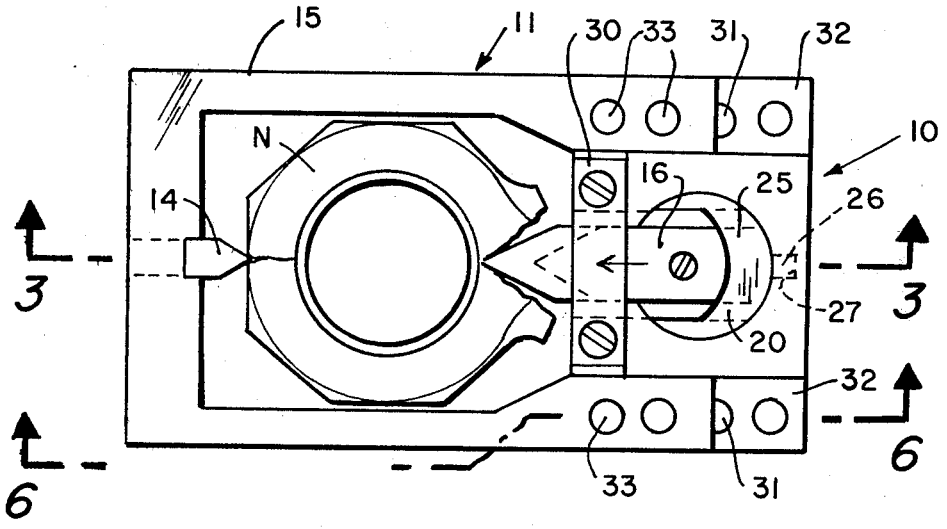
FIG. 2 is a top plan view of the nut cutting tool illustrating it associated with a nut being cut.

FIG. 3 in an enlarged vertical detail section through the cutting tool of FIG. 1, as seen along line 3—3 in FIG. 2;

FIG. 4 is a fragmentary detail section of the upper end of FIG. 3 taken substantially along line 4–4 therein;

FIG. 5 is a perspective view of the upper end of the cutting tool illustrating it associated with a nut being cut;

FIG. 6 is a side elevation of and partial section through FIG. 2 taken substantially along line 6—6 thereof, and FIG. 7 is a fragmentary perspective view of the illustration of FIG. 4.

GENERAL DESCRIPTION

Referring to the drawings the nut cutting tool generally designated 10 comprises a cutting head 11 for embracing a nut N to be cut in a plane radially of the axis of such nut, and a handle 12 at one end of the cutting head including a pressure exerting means 13 for operating the cutting tool.

As in all other forms of nut cutting tools the cutting head 11 includes a fixed cutting blade 14 anchored in the bight end of a yoke portion 15 of the head, and a movable cutting blade 16 arranged in a guideway 17 formed in the cutting head 11 for movement in a plane toward and from the fixed cutting blade 14.

DETAILED DESCRIPTION

The handle 12 of the tool 10 is a tubular member 18 having its axis disposed normal to the plane in which the movable cutting blade 16 is guided within the cutting head 11 of the tool. That portion of the tubular member which merges with the guide porton 17 of the cutting head 11 is provided with a guideway 19 to guide a cam block 20 for axial movement therein for operative engagement with the opposite or non-cutting end 28 of the movable cutting blade 16 in the cutting head.

The cam block 20 is limited for movement within the guideway 19 between an inactive and an active position. Its inactive position is lower-most as best seen in FIGS. 3, 4 and 7 whereas its active position is uppermost in those views as well as the normal position of the tool during use as shown in FIG. 1.

The cam block 20 when in its lowermost inactive position as seen in FIG. 3 is disposed to engage the upper end 21 of a plunger 22 which is part of the pressure exerting means 13. In the present disclosure the pressure exerting means 13 is in the form of a screw 23 threadedly associated with internal threading in the lower tubular portion 18 of the handle 12. The threading between the screw 23 and tubular handle is shown to be of the square type for exerting a safe and efficient upward thrust to the plunger 22 upon turning of the screw within the handle by means of a cross bar 24 or the like at the lower free end of the screw.

The upper, inner end 21 of the screw plunger 22 is preferably ball shaped, i.e., hemispherical in form for exerting a center-most force against the cam block 20 with a minimum of friction between them.

It should here be noted that the plunger 22 of the pressure exerting means 13 may be urged to move axially within the handle 12 by a power tool torque wrench, not shown, adapted to yield or slip upon a resistance of a force greater than the capacity of the slip clutch of such torque wrench. It is also feasible that the pressure exerting means 13 be in the form of the piston of an hydraulic ram in place of the screw type plunger disclosed.

At all events, the present invention resides in the relationship between the cam block 20 and the movable cutting knife 16 and the right angled relationship of the two guideways 17 and 19 between the cutting head 11 and pressure exerting means 13.

To this end the cam block 20 has an inclined upper surface 25 normally disposed within its guideway 19 to face the movable cutting blade body, the nut to be cut and the fixed cutting blade within the cutting head. For this reason the cam block 20 is keyed for up and down movement relative to the tubular member 18 of the handle by having a key 26 projecting from the block 20 into a vertically disposed keyway 27 formed in the tubular member. The keyway 27 is formed on that side of the guideway 19 which is opposite the direction of extension of the cutting head 11 from the handle 12. This assures the constant disposition of the inclined upper surface 25 of the cam block 20 in a position for operative engagement with the after end 28 of the movable cutting blade which is convexed at its lowermost aft corner 29 for tangentially engaging the inclined upper surface 25 of the cam block 20. By the foregoing arrangement when actuating movement of the plunger 22 is moved toward the convexed corner 29 of the cutting blade, the ball shaped end 21 of the plunger will be pressed against the cam block 20 to urge the latter upwardly in its guideway 19 as shown in dotted lines of FIG. 3. Movement of the plunger being transversely of that of the movable cutting blade will cause the inclined upper surface 25 of the cam block 20 to shift the movable cutting blade 16 along its guideway 17 toward the nut N to be cut.

It will here be noted that the cutting head 11 is provided with a cap strip 30 which overlies the movable cutting blade 16 adjacent its cutting end. Thus the cutting blade 16 is forced in direct alignment laterally toward the nut N to crack and or cut the same as seen in FIG. 2.

It will also be noted that the cam block 20 is cylindrical in shape for sliding fit within the tubular guideway 19 at the upper end 18 of the tubular handle 12. Moreover, the acute inclination of the inclined surface 25 during vertical movement is such as to wedgingly engage the convexed corner 29 of the laterally movable cutting blade 16 to achieve a smooth, positive and forceful camming action therewith. Once the nut N has been cut and the plunger 22 withdrawn, the cam block 20 will fall by gravity and the movable cutting blade 16 will be free for sliding movement within its guideway 17.

In the present disclosure the nut N to be cut is shown to be of the largest size usually employed on sink drains. In the event of the tool 10 being required to cut a nut of lesser size, the yoke 15 of the cutting head 11 is demountable, not only for mounting around an existing pipe line but also for decreasing the distance between the fixed cutting blade 14 and the extreme inner, i.e., cutting position of the cutting edge of the movable cutting blade 16. This is accomplished by providing a series of laterally spaced apertures 31 in the recessed shouldered sides 32 of the cutting head 11 to receive mounting pins 33 projecting downwardly from the extreme ends of the side arms of the yoke 15 as best seen in FIG. 6.

Having thus described my improvements in a nut cutting tool in specific detail what I claim as new and desire to protect by Letters Patent is:

1. A nut cutting tool comprising:

(a) a cutting head;

(b) a yoke mounted on said cutting head for embracing a nut to be cut;

(c) a fixed cutting blade mounted on said yoke for engaging a nut to be cut;

(d) a movable cutting knife;

(e) a first named guideway formed on said cutting head for supporting and guiding said movable cutting knife along a cutting plane toward said fixed cutting blade and nut to be cut;

(f) a tubular handle on one end of said cutting head opposite said yoke and having an axis extending at right angles to the cutting plane of the movable cutting knife;

(g) pressure exerting means movable axially of and within said tubular handle;

(h) a second named guideway formed in said tubular handle adjacent the non-cutting end of said cutting head and in communication with the first named guideway; and (i) a cam block arranged in said second named guideway for movement therein by said pressure exerting means, said cam block having a cam surface thereon disposed to face the after end of said movable cutting knife for wedgingly driving said movable cutting knife toward a nut to be cut in response to the operation of said pressure exerting means.

2. The nut cutting tool in accordance with claim 1 in which said yoke has a bight portion for supporting said fixed blade at the cutting plane and a pair of side arms removably mounted on said cutting head in a fixed disposition relative to the nut to be cut.

3. A nut cutting tool comprising:

(a) a cutting head;

(b) a yoke mounted on said cutting head for embracing a nut to be cut;

(c) a fixed cutting blade mounted on said yoke for engaging a nut to be cut;

(d) a movable cutting knife;

(e) a first named guideway formed on said cutting head for supporting and guiding said movable cutting knife along a cutting plane toward said fixed cutting blade and nut to be cut;

(f) a tubular handle on one end of said cutting head opposite said yoke and having an axis extending at right angles to the cutting plane of the movable cutting knife;

(g) pressure exerting means movable axially of and within said tubular handle;

(h) a second named guideway formed in said tubular handle adjacent the non-cutting end of said cutting head and in communication with said first named guideway;

(i) a cam block arranged in said second named guideway for movement therein by said pressure exerting means, said cam block having a cam surface thereon disposed to face toward the after end of said movable cutting knife for wedgingly driving said movable cutting knife toward a nut to be cut in response to the operation of said pressure exerting means, (j) said yoke having a bight portion for supporting said fixed blade at the cutting plane and a pair of side arms removably mounted on said cutting head in a fixed disposition relative to the nut to be cut, (k) said cutting head having a pair of shouldered sides formed thereon to receive the free ends of said pair of side arms of said yoke, each of said shouldered sides of said cutting head having a plurality of apertures formed vertically thereon and spaced longitudinally thereof in parallelism with said cutting plane; and (l) pin means on each of said arms of said yoke adapted to fit into any pair of apertures in said shouldered sides of said cutting head on opposite sides of said cutting plane to support the fixed blade on the bight portion of said yoke as close as possible to the nut to be cut.

4. The nut cutting tool in accordance with claim 1 in which the cam surface on said cam block is an inclined surface tapering toward its end facing the first named guideway in said cutting head and declining toward its opposite larger end to thereby move said movable cutting knife away from said second named guideway in said tubular handle upon progressive movement of said cam block under the influence of said pressure exerting means.

5. The nut cutting tool in accordance with claim 4 in which said pressure exerting means is a screw shank threadedly mounted for axial movement within said tubular handle.

6. The nut cutting tool in accordance with claim 5 in which said screw shank has an hemispherical end for centrally engaging said cam block.

7. The nut cutting tool in accordance with claim 4 in which said pressure exerting means is a plunger having an hemispherical end for engaging said cam block axially thereof.

* * * * *